US011617416B2

(12) United States Patent
Nishiwaki et al.

(10) Patent No.: US 11,617,416 B2
(45) Date of Patent: Apr. 4, 2023

(54) SHOE UPPER

(71) Applicant: ASICS CORPORATION, Hyogo (JP)

(72) Inventors: Tsuyoshi Nishiwaki, Hyogo (JP); Shingo Takashima, Hyogo (JP); Hisanori Fujita, Hyogo (JP); Kenta Moriyasu, Hyogo (JP)

(73) Assignee: ASICS CORPORATION, Hyogo (JP)

( * ) Notice: Subject to any disclaimer, the term of this patent is extended or adjusted under 35 U.S.C. 154(b) by 248 days.

(21) Appl. No.: 16/494,763

(22) PCT Filed: Mar. 20, 2017

(86) PCT No.: PCT/JP2017/011072

§ 371 (c)(1),
(2) Date: Sep. 16, 2019

(87) PCT Pub. No.: WO2018/173094

PCT Pub. Date: Sep. 27, 2018

(65) Prior Publication Data

US 2020/0029655 A1 Jan. 30, 2020

(51) Int. Cl.
*A43B 23/02* (2006.01)
*D04B 1/24* (2006.01)

(52) U.S. Cl.
CPC ..... *A43B 23/0205* (2013.01); *A43B 23/0245* (2013.01); *D04B 1/24* (2013.01); *D10B 2501/043* (2013.01)

(58) Field of Classification Search
CPC .. D04B 1/123; D04B 1/14; D04B 1/18; A43B 1/04; A43B 23/0245; A43B 23/025; A43B 23/0205
See application file for complete search history.

(56) References Cited

U.S. PATENT DOCUMENTS 1,828,320 A 10/1931 Daniels
2,222,178 A * 11/1940 Keshefsky ..... D03D 11/00 428/99

(Continued)

FOREIGN PATENT DOCUMENTS

EP 3114951 1/2017
GB 491131 8/1938

(Continued)

OTHER PUBLICATIONS

"International Search Report (Form PCT/ISA/210) of PCT/JP2017/011072," dated Jun. 13, 2017, with English translation thereof, pp. 1-4.

*Primary Examiner* — Megan E Lynch
(74) *Attorney, Agent, or Firm* — JCIPRNET

(57) ABSTRACT

An upper of a shoe covering at least a part of a foot, the upper including: a medial portion covering a medial surface of the foot; a lateral portion covering a lateral surface of the foot; a plurality of panel portions provided in the medial portion and/or the lateral portion while being spaced apart from each other in a front-rear direction of the foot and extending in a foot girth direction crossing the front-rear direction of the foot; and a plurality of string portions formed from linear members extending in the front-rear direction, and arranged so as to extend between a pair of the plurality of panel portions that are adjacent to each other in the front-rear direction, wherein the panel portion and the string portion are formed from a single piece of fabric.

10 Claims, 12 Drawing Sheets

(56) References Cited

U.S. PATENT DOCUMENTS 2,440,393 A * 4/1948 Clark ..... A43B 1/02 12/142 G
3,930,387 A * 1/1976 Imamura ..... D04B 1/14 66/190
5,508,098 A * 4/1996 Omar ..... B32B 5/26 442/319
5,615,562 A * 4/1997 Roell ..... D04B 15/565 66/126 R
6,151,922 A * 11/2000 Shimasaki ..... D04B 1/18 66/61
2005/0115284 A1* 6/2005 Dua ..... A43B 23/042 66/178 R
2005/0193592 A1* 9/2005 Dua ..... D04B 1/102 36/45
2005/0208860 A1* 9/2005 Baron ..... A41D 27/28 442/414
2006/0207296 A1* 9/2006 Fujikawa ..... D03D 7/00 66/202
2008/0110049 A1 5/2008 Sokolowski et al.
2013/0008053 A1 1/2013 Nishiwaki et al.
2013/0212907 A1* 8/2013 Dua ..... A43B 9/00 36/83
2013/0260104 A1* 10/2013 Dua ..... A41D 27/245 428/175
2014/0101816 A1* 4/2014 Toronjo ..... A45F 3/12 2/69
2014/0157623 A1* 6/2014 Dekovic ..... A43B 23/0215 36/47
2014/0237861 A1* 8/2014 Podhajny ..... D04B 1/123 36/9 R
2014/0245547 A1* 9/2014 Baudouin ..... A43B 23/26 12/146 C
2014/0310983 A1 10/2014 Tamm et al.
2015/0104592 A1* 4/2015 Itoi ..... A43B 1/0045 428/35.2
2015/0359290 A1* 12/2015 Podhajny ..... D04B 1/123 36/9 R
2016/0053415 A1* 2/2016 Ikenaka ..... D04B 7/30 66/194
2016/0058099 A1* 3/2016 Panian ..... A43B 23/0245 36/84
2016/0058100 A1* 3/2016 Dealey ..... A43C 1/04 12/142 G
2016/0088893 A1* 3/2016 Meir ..... A43B 23/0245 36/84
2016/0095377 A1 4/2016 Tamm
2016/0168767 A1* 6/2016 Bader ..... D04B 1/123 442/60
2016/0174660 A1* 6/2016 Iuchi ..... A43B 23/0235 36/45
2016/0213095 A1* 7/2016 Kohatsu ..... A43B 1/04
2016/0302527 A1* 10/2016 Meir ..... A43B 23/0245
2016/0309843 A1* 10/2016 Song ..... A43B 7/06
2016/0331083 A1* 11/2016 Uesato ..... A43B 23/0265
2017/0020231 A1* 1/2017 Hausmann ..... A43B 23/026
2017/0215523 A1* 8/2017 Nishiwaki ..... A43B 7/08

FOREIGN PATENT DOCUMENTS

GB 491131 A * 8/1938 ..... A43B 1/04
JP 2012196488 10/2012
JP 2014210176 11/2014
JP 2016073627 5/2016
WO WO-0026455 A1 * 5/2000 ..... A43B 23/0265
WO 2007140054 12/2007
WO 2008000398 1/2008
WO 2011011176 1/2011
WO 2011028444 3/2011
WO 2011129017 10/2011
WO 2015181928 12/2015

* cited by examiner

X
Y
3
7
8
60
P6
P
2
6
1
10
11
12
10(10b)
33
10a
10b
13

SHOE UPPER

CROSS-REFERENCE TO RELATED APPLICATION

This application is a 371 application of the International PCT application serial no. PCT/JP2017/011072, filed on Mar. 20, 2017. The entirety of each of the above-mentioned patent applications is hereby incorporated by reference herein and made a part of this specification.

TECHNICAL FIELD

The present invention relates to an upper of a shoe.

BACKGROUND ART

In sports such as tennis, volleyball and soccer, a player needs to perform the direction-changing action and the braking action many times. Due to such characteristics of these sports, the upper needs to be stable in the transverse direction. Therefore, the stability of the upper has been ensured for currently-used athletic shoes by using an artificial material having a high rigidity or a polyurethane-made resin material.

However, while these shoes enjoy their high stability, they are heavy and the upper buckles when bent, and the fitting quality is poor. Particularly, due to the characteristics of the sports described above, the upper undergoes a twist, or the like, in addition to simple deformations such as stretching and shrinking. Therefore, uncomfortable creases are likely to occur (awkwardness is likely to be felt on the surface of the foot), and there is a demand for improving the fitting quality. Uppers have been under development that partially use a low-rigidity mesh member or stretchable member as a way to improve the fitting quality.

CITATION LIST

Patent Literature

First Patent Document: WO 2011/129017 A1 (front page)
Second Patent Document: WO 2008/398 A1 (front page)
Third Patent Document: WO 2007/140054 A1 (front page)
Fourth Patent Document: JP2012-196488 A (front page)
Fifth Patent Document: WO 2011/028444 A1 (front page)
Sixth Patent Document: WO 2011/011176 A1 (front page)
Seventh Patent Document: WO 2015/181928 A1 (front page)

SUMMARY OF INVENTION

The structure of the upper disclosed in WO 2011/129017 A1 will realize a reduction of weight and also realize a unique improvement to the fitting quality. With this technique, however, the reinforcement in the foot width direction is unlikely to be high, and one may not be able to expect an improvement to the stability.

Thus, it is an object of the present invention to provide a novel upper structure with stability, light weight and fitting quality.

An upper of the present invention is an upper 3 of a shoe covering at least a part of a foot, the upper 3 including:

a medial portion 31 covering a medial surface of the foot;

a lateral portion 32 covering a lateral surface of the foot;

a plurality of panel portions 11 provided in a medial portion 31 and/or a lateral portion 32 while being spaced apart from each other in a front-rear direction Y of the foot and extending in a foot girth direction X crossing the front-rear direction Y of the foot; and a plurality of string portions 10 formed from linear members extending in the front-rear direction Y, and arranged so as to extend between a pair of the plurality of panel portions 11 that are adjacent to each other in the front-rear direction Y, wherein a panel portion 11 and a string portion 10 are formed from a single piece of fabric 1.

The string portions formed from linear members refer to portions that are linear and thinner than ropes, as opposed to the panel portions.

Note that the front-rear direction Y refers to a horizontal direction that is parallel to the longitudinal axis of the foot or a direction that is inclined in the up-down direction and/or the medial-lateral direction relative to the horizontal direction.

The plurality of panel portions extending in the foot girth direction X will serve to stably support the upper. A string portion arranged between a pair of panel portions will serve to reduce the weight of the upper.

The string portions, as compared with an ordinary upper member having a planar structure, will more easily twist and will more easily exhibit a deformation of shrinking by being bent. Therefore, the upper will easily deform in conformity to a shrinking deformation of the foot, or the like, following a deformation of the foot. Thus, the fitting quality will improve.

The panel portions and the string portions that are formed from a single piece of fabric, as compared with a case where the panel portions are formed from a resin plate or a tape material, will serve to further improve the fitting quality and reduce the weight, and will also serve to reduce the cost as the number of parts is smaller.

BRIEF DESCRIPTION OF DRAWINGS

In FIG. 1 and FIG. 2A, some string portions are shown to be thinner to make it easier to see the arrangement of the string portions.

In FIG. 7 and FIG. 8, the string portions are modified in the digital pictures to make it easier to see the thickness of the string portions.

DESCRIPTION OF EMBODIMENTS

Figure 1:
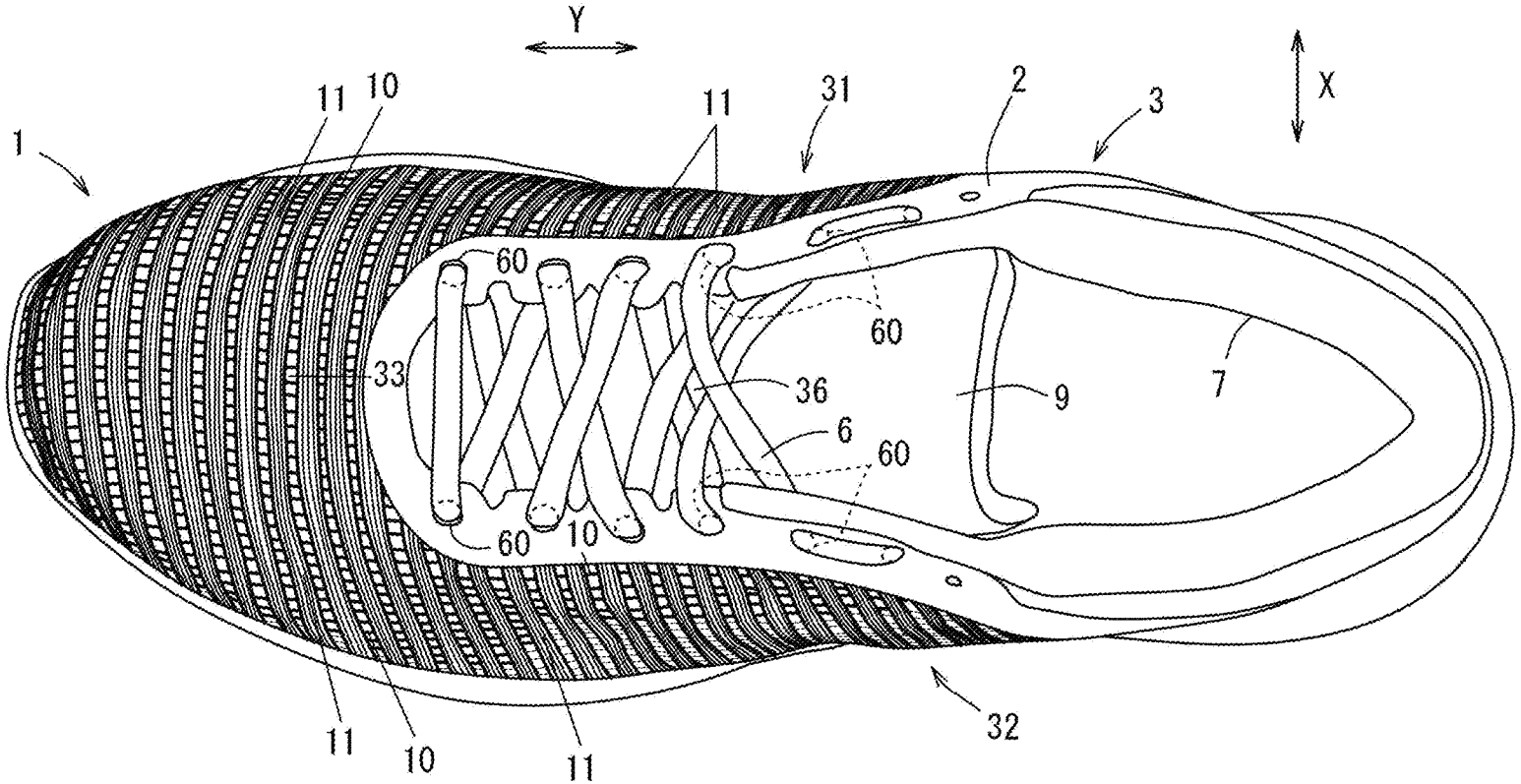
FIG. 1 is a schematic plan view showing a shoe having an upper according to an embodiment of the present invention.

Preferably, an average value of a width of the panel portion 11 in the front-rear direction Y is greater than an average value of a thickness of the string portion 10 in the girth direction X.

In this case, thin string portions will improve the lightness and the fitting quality.

Preferably, each of the panel portions 11 is in a strip shape extending in the girth direction X, and defines a plurality of through holes H that are spaced apart from each other in the girth direction X;

each of the string portions 10 is passed through the corresponding through hole H; and in each of the through holes H, the panel portion 11 fastens a circumference of each of the string portions 10.

The string portions of which the circumference is fastened by the panel portions in the through holes are unlikely to come off the panel portions. This will improve the durability of the fabric.

Preferably, adjacent string portions 10 of the plurality of string portions 10 extending in the front-rear direction Y are spaced apart from each other in the girth direction X.

The plurality of string portions spaced apart from each other in the girth direction will help the fabric fit to the foot over a large area.

Preferably, each of the string portions 10 includes fastened (tightened) portions 10*a* that are fastened by the panel portions 11 in the through holes H of the plurality of panel portions 11, and exposed portions 10*b* that are exposed between adjacent panel portions; and a thickness of the fastened portion 10*a* in the girth direction X is smaller than a thickness of an exposed portion 10*b* in the girth direction X.

In the fastened portions thinner than the exposed portions, the fastened string portions engage with the panel portions, which will prevent the string portions from coming off the panel portions.

More preferably, each string portion 10 is a bundle of fiber filaments, wherein the fiber filaments are not bonded together; and the fiber filaments are bundled more closely in the fastened portion 10*a* than in the exposed portion 10*b*.

The string portions, each formed from a bundle of fiber filaments not bonded together, have their circumferences fastened by the panel portions, and the fiber filaments are likely to be more closely bundled and the string portions are likely to be thinner in the fastened portion 10*a* than in the exposed portion 10*b*. Therefore, it will be easier to prevent the string portions from coming off.

More preferably, each string portion 10 is a non-twisted yarn.

The string portions, which are not monofilament or twisted yarns, can easily be made thinner by being fastened, making it possible to prevent the string portions from coming off the panel portions.

Preferably, the panel portions 11 are each formed from a knit fabric; and yarns of the knit fabric define the through holes H and fasten the circumference of the string portion 10 in the through holes H.

As compared with a panel portion of a resin plate, or the like, a panel portion formed from a knit fabric is more flexible and generally has a good fitting quality and lightness.

The through holes H of a panel portion formed from a knit fabric, as compared with a woven fabric, or the like, will be more capable of fastening the string portions 10.

More preferably, the knit fabric is formed from a warp knit fabric.

A warp knit fabric has a better durability than a weft knit fabric.

Preferably, each of the string portions 10 includes fastened portions 10*a* that are fastened in the through holes H of the plurality of panel portions 11 and includes exposed portions 10*b* that are exposed between adjacent panel portions 11, wherein the fastened portions 10*a* and the exposed portions 10*b* alternate with each other in the front-rear direction Y;

a ladder portion 12 is defined in the medial portion 31 and/or a lateral portion 32, the ladder portion 12 including a plurality of the exposed portions 10*b* of the string portion 10 that are arranged intermittently in the foot girth direction X between a pair of panel portions 11 that are adjacent to each other;

a plurality of such ladder portions 12 are arranged intermittently in the front-rear direction Y; and the plurality of ladder portions 12 and the plurality of panel portions 11 are arranged so as to alternate with each other in the front-rear direction Y.

A fabric including the ladder portions 12 and the panel portions 11 alternating with each other in the front-rear direction Y will be easily formed from a knit fabric or a woven fabric. The stability, the lightness and the fitting quality will easily be realized.

More preferably, the upper 3 includes a fastening member 6 configured to pull the plurality of panel portions 11 toward a central portion 36 between a medial side and a lateral side of the foot;

the medial portion 31 and/or the lateral portion 32 each include a plurality of engagement portions 60 with which the fastening member 6 engages; and in the medial portion 31 or lateral portion 32, one panel portion 11 and a pair of the ladder portions 12 that are anterior and posterior to the panel portion 11 are arranged in an area of the upper 3, the area corresponding to a width between a pair of engagement portions 60 that are adjacent to each other.

When one panel portion 11 and a pair of the ladder portions 12 that are anterior and posterior to the panel portion 11 are arranged in the corresponding area of the upper 3 between a pair of engagement portions 60 that are adjacent to each other, it is possible to arrange a large number of panel portions 11 and ladder portions 12 with a short pitch. This will improve the stability and the fitting quality.

Preferably, the upper 3 includes a fastening member 6 configured to pull the plurality of panel portions 11 toward a central portion 36 between a medial side and a lateral side of the foot;

the medial portion 31 and/or the lateral portion 32 each include a plurality of engagement portions 60 with which the fastening member 6 engages; and a plurality of the panel portions 11 and the ladder portions 12 are arranged so as to alternate with each other in the front-rear direction Y in a toe portion 33 of the upper 3, the toe portion being anterior to the most anterior one of the engagement portions 60.

When a plurality of the panel portions 11 and the ladder portions 12 are arranged so as to alternate with each other in the front-rear direction Y in the toe portion 33, the part from the toe portion 33 to the midfoot portion can be formed from a single piece of fabric. Therefore, it is possible to further improve the lightness and reduce the cost.

Preferably, the piece of fabric includes a plurality of yarns 13; and some or all of the plurality of yarns 13 are melt-binding (hot-melt) yarns, and the melt-binding yarns form a melt-binding structure where yarns are melt-bound together.

A melt-binding yarn as used herein includes a hot-melt yarn, and includes a twisted yarn-like yarn that is obtained by twisting and bundling together a plurality of melt-binding fiber filaments. A melt-binding yarn may be a multi-strand obtained by twisting together a large number of fiber filaments, or may be a monofilament made of a single fiber filament.

With a multi-strand, it may be obtained by twisting a large number of melt-binding fibers having a core-sheath structure, or may be obtained by arranging a fiber of a high melting point at the axial core and arranging a melt-binding fiber having a core-sheath structure therearound. The core-sheath structure may include a heat-shrinkable core portion and a sheath portion having a lower melting point than the core portion.

When the melt-binding yarn is formed from a monofilament, it may be a single fiber filament of a core-sheath structure. The core-sheath structure may include a heat-shrinkable core portion and a sheath portion having a lower melting point than the core portion.

The sheath portion may be arranged only on a part of the surface of the core.

Yarns melt-bound together refers not only to cases where all the yarns are melt-bound together but also to cases where some of the yarns are melt-bound together. Yarns melt-bound together refers not only to cases where the yarns are entirely melt-bound together but also to cases where the yarns are partially melt-bound together.

In melt-binding yarns forming the melt-binding structure, the yarns or fiber filaments tighten, thereby fastening the circumferences of the string portions in areas of the through holes H. Therefore, it will be easier to prevent the string portions from coming off the through holes H of the panel portions.

More preferably, the melt-binding yarns having the melt-binding structure melt-bind together yarns of the panel portion 11.

In this case, in the panel portions where the melt-binding structure is formed, the rigidity of the fabric increases, and it is therefore possible to improve the stability and to realize a further reduction in weight by making the panel portions thinner.

Preferably, some or all of the yarns are non-stretching.

When the foot is urged to shift toward the medial side or the lateral side inside the upper, non-stretching string portions or panel portions will not stretch beyond a predetermined length, thereby supporting the medial and lateral side surfaces of the foot. This will result in a good stability.

In the present invention, non-stretching means to include non-elastic string portions that do not either stretch or shrink, and to further include string portions and panel portions that do not substantially stretch beyond a predetermined length (under a force that is applied while being worn) but are capable of shrinking from the predetermined length.

EMBODIMENTS

The present invention will be understood more clearly from the following description of preferred embodiments taken in conjunction with the accompanying drawings. Note however that the embodiments and the drawings are merely illustrative and should not be taken to define the scope of the present invention. The scope of the present invention shall be defined only by the appended claims. In the accompanying drawings, like reference numerals denote like components throughout the plurality of figures.

Any feature illustrated and/or depicted in conjunction with one embodiment or alternative examples may be used in the same or similar form in one or more of alternative embodiments or alternative examples, and/or may be used in combination with, or in place of, any feature of the alternative embodiments.

Embodiment 1

Embodiment 1 of the present invention will now be described with reference to FIG. 1 to FIG. 9.

A shoe for the left foot will be illustrated in the following description.

Figures 2A, 2B:
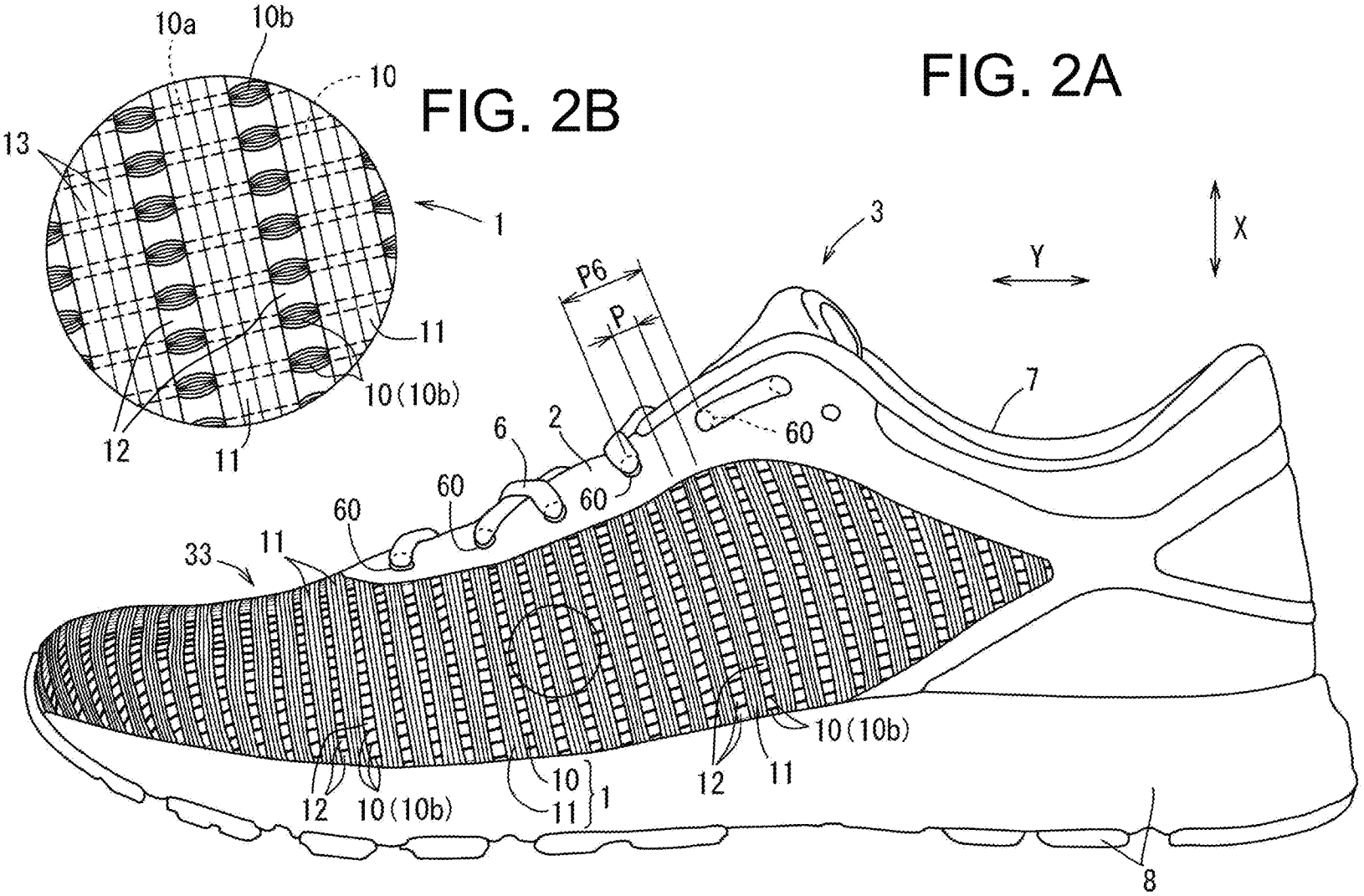
FIG. 2A is a schematic side view of a shoe showing an upper according to an embodiment as seen from the lateral side.
FIG. 2B is an enlarged conceptual view showing, on an enlarged scale, a part of the primary fabric of the upper.

The shoe shown in FIG. 1 is a shoe for sports or running, for example, and includes an upper 3 secured to a sole 8 shown in FIG. 2A. The upper 3 includes a flexible fabric 1, a reinforcement member 2 and a shoelace (fastening member) 6. A tongue 9 of FIG. 1 may be provided on the upper 3.

The sole 8 of FIG. 2A is placed under the upper 3 and is to be in contact with the road surface. The flexible fabric 1 is formed so as to wrap the medial surface, the lateral surface and the toe of the foot. The reinforcement member 2 and the shoelace 6 are for fitting the flexible fabric 1 to the instep.

In the case of the present example, as shown in FIG. 1 and FIG. 2A, the fabric 1 is drawn with a pattern so as to show the structure of the fabric 1.

Although the end portions of the shoelace 6 are not shown in FIG. 1 and FIG. 2A, the end portions are firmly tied together after the foot is inserted in the upper 3. As the end portions of the shoelace 6 are tied together, the upper 3 fits to the foot.

As shown in FIG. 1 and FIG. 2A, the upper 3 includes a top line (wearing opening) 7 allowing the foot to be inserted to wear the shoe. The leg protrudes upward through the top line 7 when the shoe is worn, and the shoelace 6 is placed in an area anterior to the top line 7.

In FIG. 1, the upper 3 includes the medial portion 31 covering the medial surface of the foot, the lateral portion 32 covering the lateral surface of the foot, the central portion 36 between the medial side and the lateral side, and the toe portion 33 that is anterior to the most anterior one of the engagement portions 60. The upper 3 extends in the front-rear direction Y and in the girth direction X.

The fabric 1 may be formed from a woven/knit fabric.

While the term woven/knit fabric in general refers generically to woven fabrics and knit fabrics, and the term as used herein means to include fabrics that are difficult to classify as either a woven fabric or a knit fabric.

The fabric 1 includes a plurality of string portions 10 and panel portions 11 alternating with each other in the front-rear direction Y.

In FIG. 1, in the toe portion 33, the medial portion 31 and the lateral portion 32, the panel portions 11 are spaced apart from each other in the front-rear direction Y of the foot and extend in the foot girth direction X, which crosses the front-rear direction Y of the foot.

The string portions 10 are formed from linear members extending in the front-rear direction Y, and are arranged so as to extend between a pair of the panel portions 11 that are adjacent to each other in the front-rear direction Y.

The panel portions 11 and the string portions 10 are formed from a single piece of fabric.

Figure 3:
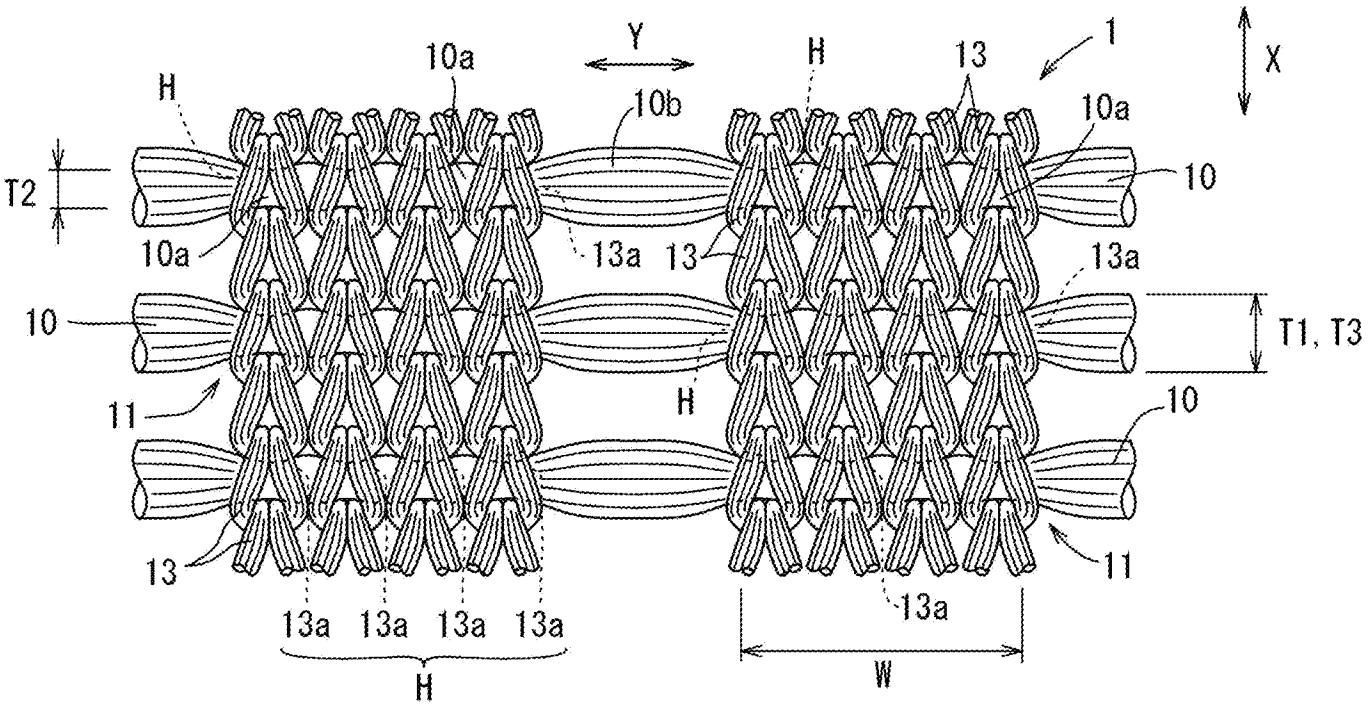
FIG. 3 is a super-enlarged conceptual view showing, on a further enlarged scale, showing the part of the fabric.

In the present example, as shown in FIG. 3, the minimum width W of the panel portion 11 in the front-rear direction Y is greater than the maximum thickness T1 of the string portion 10 in the girth direction X. Therefore, the average value of the width of the panel portion 11 in the front-rear direction Y is greater than the average value of the thickness of the string portion 10 in the girth direction X.

Figure 9:
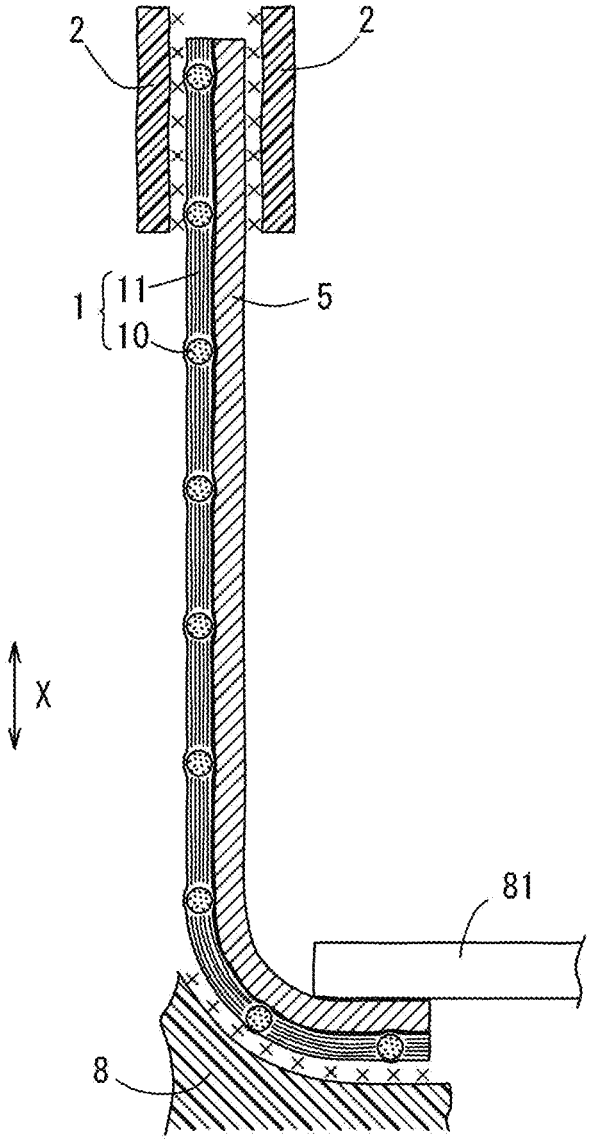
FIG. 9 is a cross-sectional view showing the upper cut off along the girth direction in which a ladder portion extends.

As shown in the cross-sectional view of FIG. 9, the string portions 10 are passed through the panel portions 11. An interior member 5 may be arranged on the reverse side of the fabric 1. The interior member 5 may be attached to the fabric 1. The interior member 5 may be formed from a material that is less stretchable than the fabric 1.

The fabric 1, together with the interior member 5, may be sandwiched between a pair of reinforcement members 2 in an upper portion of the fabric. The fabric 1, together with the interior member 5, may be sandwiched between the sole 8 and an insole 81 in a lower portion of the fabric. The fabric 1 may not be attached to the interior member 5 between the upper portion and the lower portion in the girth direction X. Note that "xx" in FIG. 9 denotes an adhesive.

A plurality of engagement portions 60 such as the eyelets of FIG. 1 may be formed in the fabric 1, the interior member 5 and the reinforcement member 2, on the medial portion 31 and on the lateral portion 32.

Figure 4:
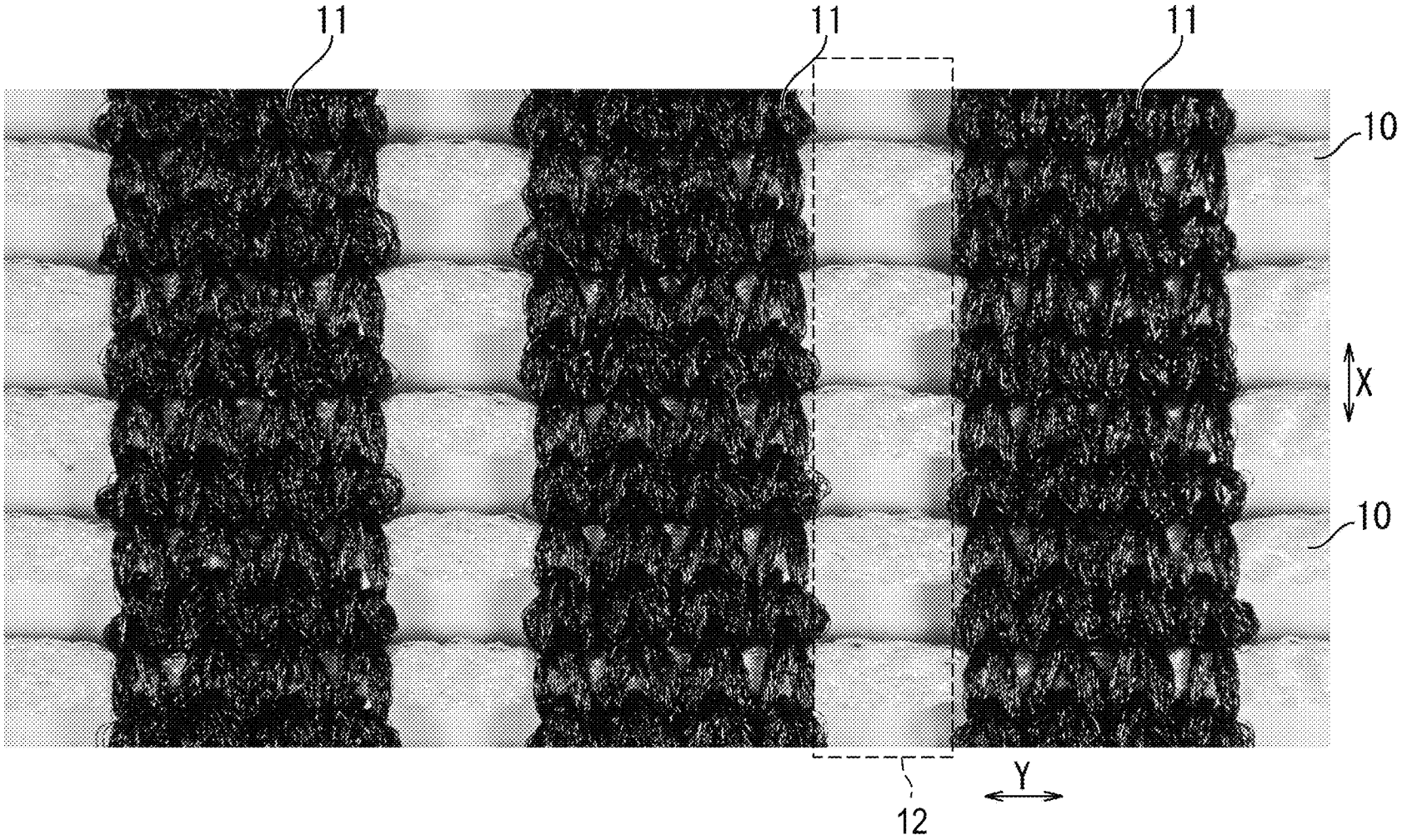
FIG. 4 is a plan view showing, in an enlarged digital picture, the front surface of the fabric.
Figure 5:
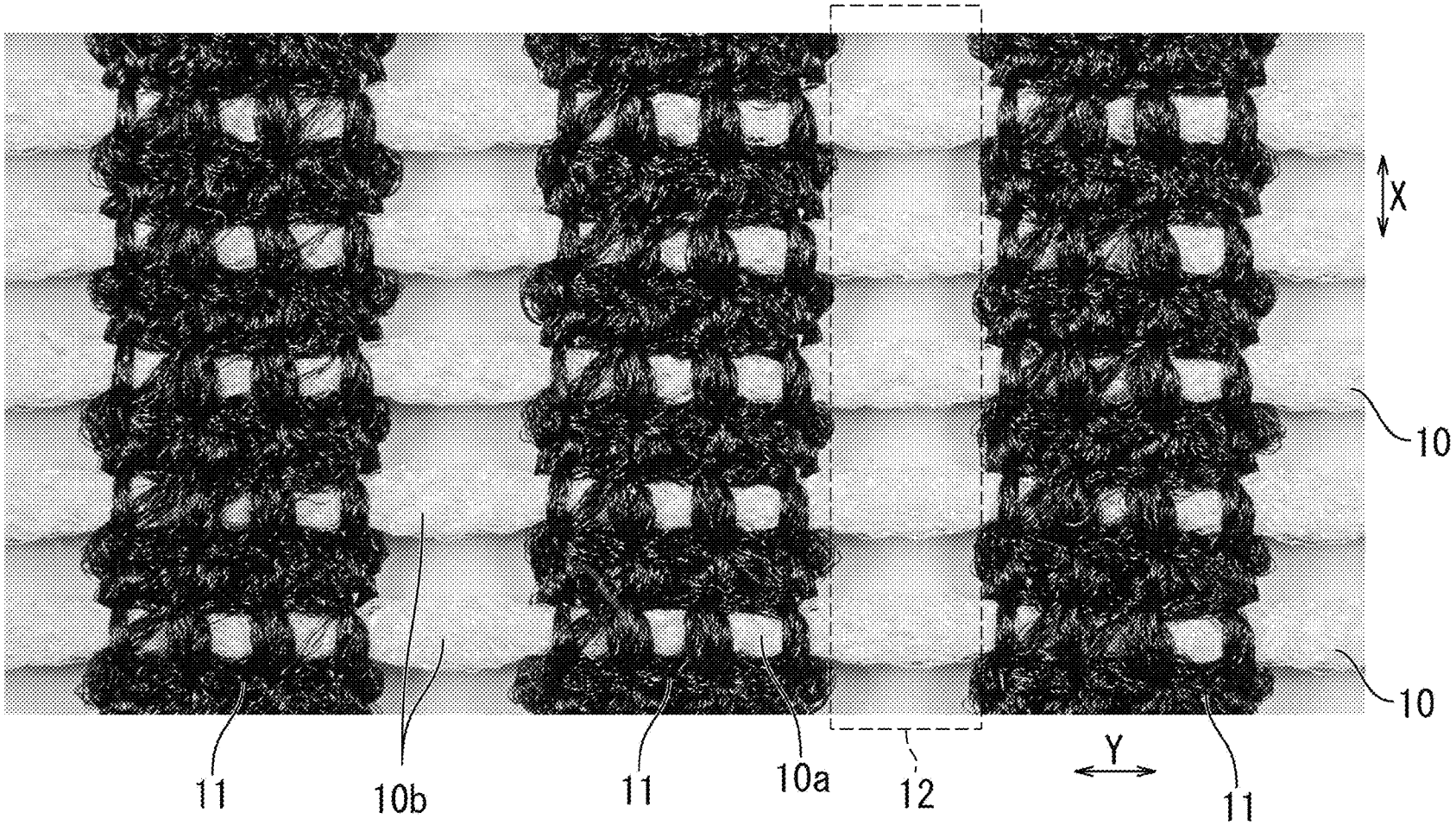
FIG. 5 is a back view showing, in an enlarged digital picture, the reverse surface of the fabric.

As shown in FIG. 3 to FIG. 5, each panel portion 11 is formed from a knit fabric. As can be seen from FIG. 7, the knit fabric may be formed from a warp knit fabric, for example. For example, the warp knit fabric may be a warp knit tricot weft-inserted fabric, a warp knit raschel (russell) weft-inserted fabric, or the like.

Figure 7:
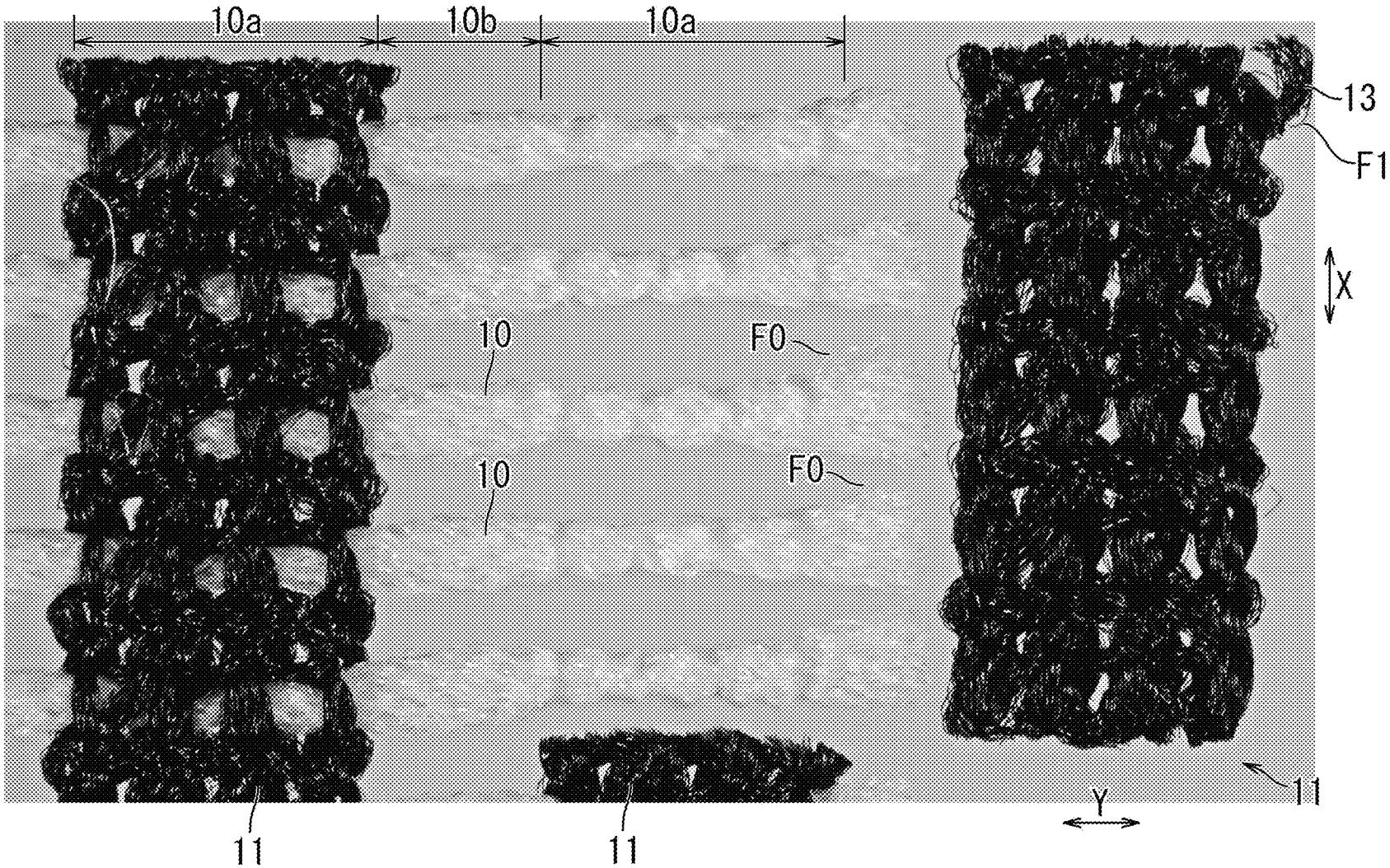
FIG. 7 is an exploded back view showing, in an enlarged digital picture, a state where the panel portion has been partially cut off and the cut-off piece of the panel portion has been removed from the fabric.

That is, each panel portion 11 of FIG. 7 may be formed from a single yarn by a knitting method such as stockinette.

In the upper right corner of FIG. 7, a single yarn 13 made of a larger number of fiber filaments F1 is frayed off of the panel portion 11. Thus, it can be seen that each panel portion 11 is formed by knitting a single yarn 13 made of a larger number of fiber filaments F1.

Figure 6A:
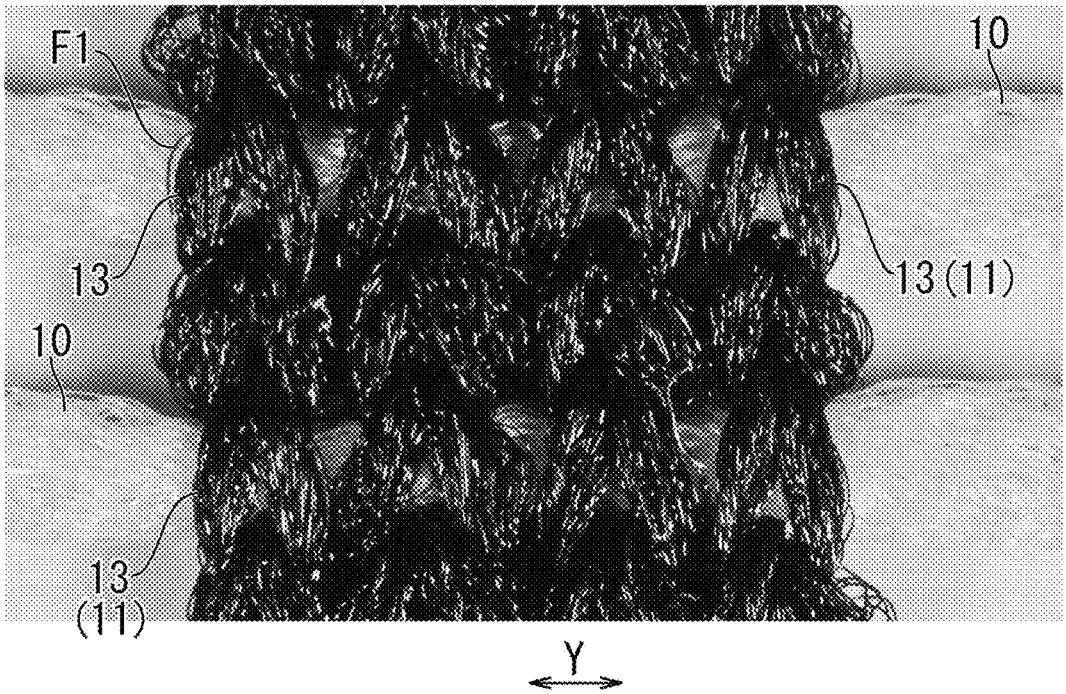
FIG. 6A is a super-enlarged plan view of FIG. 4.
Figure 6B:
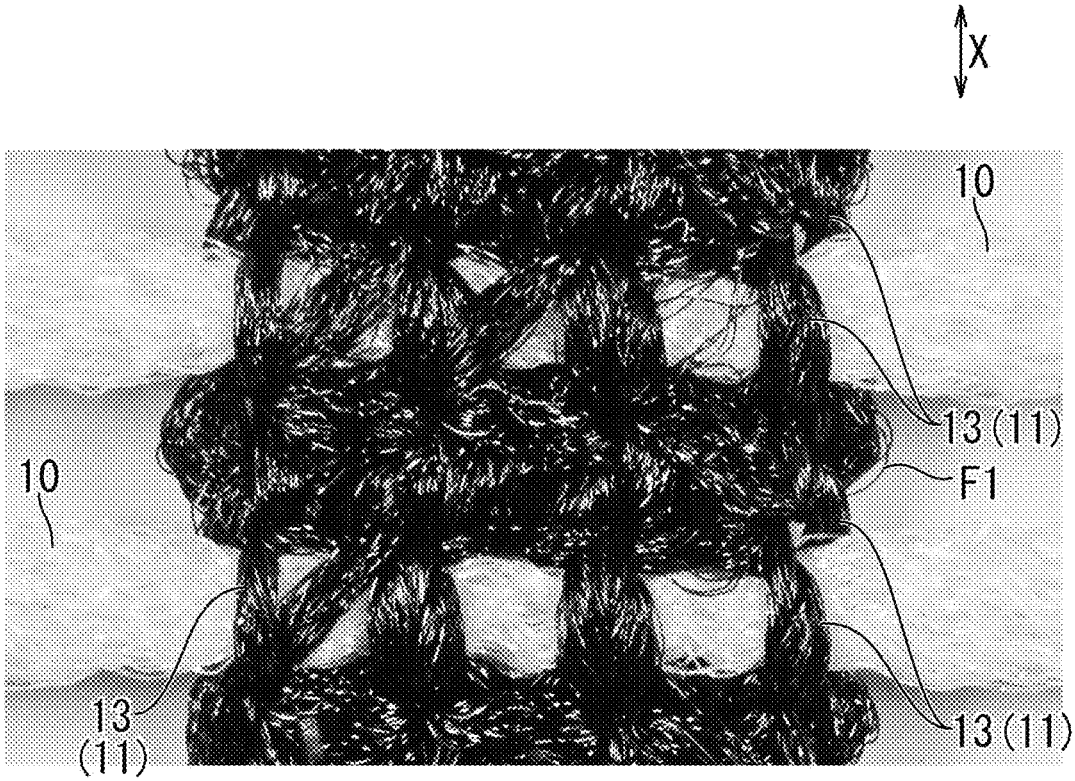
FIG. 6B is a super-enlarged plan view of FIG. 5.

As shown in FIG. 3, the yarns 13 of the panel portion 11 form a plurality of loops (stitches) 13*a*, through which a single string portion 10 is passed through the panel portion 11 in the front-rear direction Y. For a single string portion 10 to be passed therethrough, the loops 13*a* are arranged intermittently in the front-rear direction Y. As shown in FIG. 3, FIG. 6A and FIG. 6B, in each loop, the yarns 13 fasten (tighten) the circumference of each string portion 10.

A single through hole H of FIG. 3 is formed by a plurality of loops 13*a* that are arranged intermittently in the front-rear direction Y. Therefore, a single through hole H extends in the front-rear direction Y. A single string portion 10 is passed through the single through hole H. In each panel portion 11, a plurality of through holes H are provided in the girth direction X and are spaced apart from each other in the girth direction X. A single string portion 10, of the plurality of string portions 10, is passed through one of the plurality of through holes H that are spaced apart from each other in the girth direction X.

That is, each panel portion 11 made of yarns 13 forming the knit fabric defines a plurality of through holes H that are spaced apart from each other in the girth direction X of FIG. 3, and fastens the circumferences of the string portions 10 in the through holes H.

As shown in FIG. 1, each panel portion 11 is in a band shape extending in the girth direction X, and each panel portion 11 defines a plurality of loops (stitches) as shown in the enlarged views of FIG. 3, FIG. 4 and FIG. 5.

In the present example, yarns 13 forming the loops 13*a* are shown to be spaced apart from each other in the front-rear direction Y in FIG. 3, which is a super-enlarged view. On the other hand, when the panel portion 11 is seen through a magnifier, yarns 13 that are adjacent to each other in the front-rear direction Y will be seen to be arranged in contact with each other in the front-rear direction Y as shown in FIG. 2B. Therefore, when the fabric 1 is seen by naked eyes or through a magnifier, one through hole H of FIG. 3 will be seen as if a plurality of loops 13*a* that are arranged in contact with each other in the front-rear direction Y were forming a single through hole that is continuous in the front-rear direction Y.

As shown in FIG. 6A and FIG. 6B, in the through holes H (FIG. 3), the panel portions 11 fasten the circumferences of the string portions 10. That is, the yarns 13 of the panel portions 11 fasten the circumferences of the string portions 10. Adjacent string portions 10 of the plurality of string portions 10 extending in the front-rear direction Y are spaced apart from each other in the girth direction X.

As shown in FIG. 3 and FIG. 7, each string portion 10 includes fastened portions 10*a* that are fastened in through holes H of a plurality of panel portions 11, and exposed portions 10*b* that are exposed between panel portions adjacent to each other.

As shown in FIG. 3 and FIG. 7, the fastened portion 10*a* includes areas that are directly fastened by the yarns 13 of the panel portions 11, and areas where the thickness is reduced indirectly by the fastening of the yarns 13.

Figure 8:
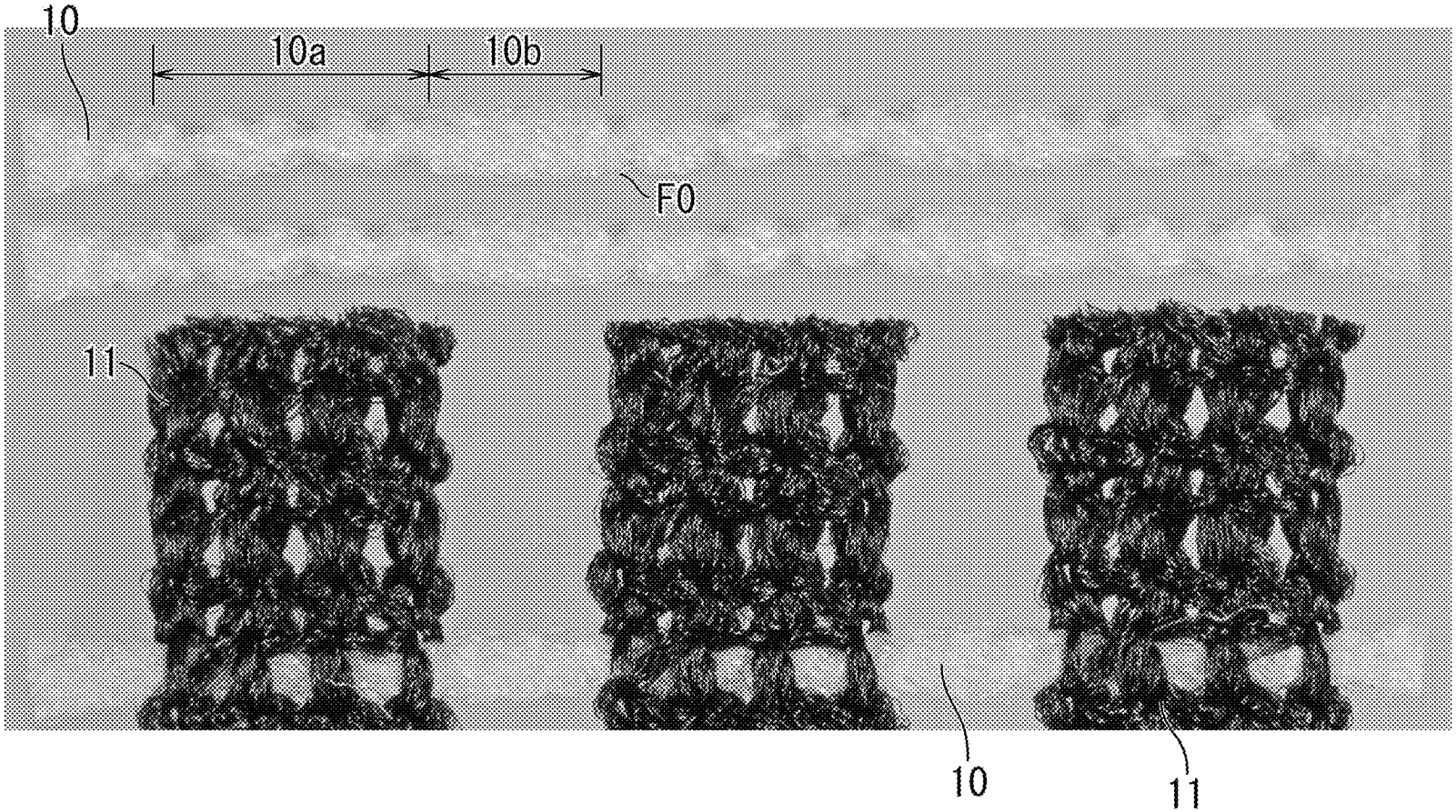
FIG. 8 is an exploded back view showing, in an enlarged digital picture, a state where the string portion has been partially cut off and the cut-off piece of the string portion has been removed from the fabric.

As shown in FIG. 7 and FIG. 8, the thickness of the fastened portion 10*a* in the girth direction X is smaller than the thickness of the exposed portion 10*b* in the girth direction X.

For example, as shown in FIG. 3, the thickness T2 in the girth direction X of the string portion 10 that is fastened by the yarn 13 of the panel portion 11 is smaller than the maximum thickness T3 of the exposed portion 10*b* in the girth direction X. Note that in FIG. 7, the end portions of the string portion 10 where the panel portion 11 has been removed flare out in the girth direction X.

As shown in FIG. 2B, the width of the panel portion 11 in the front-rear direction Y may be greater than the width of the exposed portion 10*b* in the front-rear direction Y.

As shown in FIG. 7, each string portion 10 is a bundle of fiber filaments F0, wherein the fiber filaments F0 are not bonded together. The fiber filaments F0 of the string portion 10 are bundled more closely in the fastened portion 10*a* than in the exposed portion 10*b*.

Preferably, the string portion 10 is a non-twisted yarn. The non-twisted yarn as used herein includes yarns that are mildly twisted as well as yarns that are not substantially twisted. The non-twisted yarn means that the number of twists per inch is about 0 to about 1, preferably about 0 to about 0.5, for example.

In FIG. 1, when the shoe is worn, the fastening member 6 that engages with the engagement portions 60 arranged in the reinforcement member 2 of the upper 3 pulls the plurality of panel portions 11 toward the central portion 36 between the medial side and the lateral side of the foot. The medial portion 31 and the lateral portion 32 each include a plurality of engagement portions 60 with which the fastening member 6 engages.

In the medial portion and the lateral portion, the plurality of engagement portions 60 are arranged in the front-rear direction while being spaced apart from each other.

As shown in FIG. 1 and FIG. 2A, the panel portions 11 and the ladder portions 12 are arranged so as to alternate with each other in the front-rear direction Y in the toe portion 33, the medial portion 31, and the lateral portion 32 of the upper 3. The toe portion 33 is anterior to the most anterior one of the engagement portions 60.

As shown in FIGS. 2A and 2B, the ladder portion 12 includes the exposed portions 10*b* of the string portions 10 that are arranged intermittently in the foot girth direction X. The ladder portions 12 are arranged in the toe portion 33, the medial portion 31 and the lateral portion 32, each between a pair of panel portions 11 that are adjacent to each other in the front-rear direction Y.

A plurality of ladder portions 12 are arranged intermittently in the front-rear direction Y. That is, the plurality of ladder portions 12 and the plurality of panel portions 11 are arranged so as to alternate with each other in the front-rear direction Y.

As shown in FIG. 1, in the front portion of the upper 3, the plurality of panel portions 11 extend continuously in the girth direction X across the medial portion 31, the toe portion 33 and the lateral portion 32.

In the front portion of the upper 3, the ladder portions 12 are arranged intermittently in the girth direction X across the medial portion 31, the toe portion 33 and the lateral portion 32.

That is, each ladder portion 12 is arranged in the girth direction X between a pair of the panel portions 11, adjacent to each other, of the panel portions 11 extending continuously in the girth direction X from the medial portion 31 to the lateral portion 32. Thus, the panel portions 11 and the ladder portions 12 are arranged so as to alternate with each other in the front-rear direction Y in the toe portion 33, the medial portion 31 and the lateral portion 32.

With the fabric 1 (the panel portions and the string portions) arranged over a wide area in the front portion of the upper, the toe portion is unlikely to be creased when the foot is dorsiflexed, for example, thus realizing an improved fitting quality.

In the medial portion 31 or the lateral portion 32, as shown in FIG. 2A, one panel portion 11 and a pair of ladder portions 12 anterior and posterior to the panel portion 11 are arranged in the area of the upper 3 corresponding to a width between each pair of engagement portions 60 that are adjacent to each other in the front-rear direction Y. That is, one panel portion 11 and a pair of ladder portions 12 anterior and posterior to the panel portion 11 are arranged within the width of the fabric 1 in the front-rear direction Y, which corresponds to the width between the pair of engagement portions 60 in the front-rear direction Y.

In other words, the pitch (distance) P between the panel portion 11 and the ladder portion 12 is smaller than the pitch P6 between adjacent engagement portions 60 and 60.

For example, the pitch P6 between the engagement portions 60 and 60 may be about twice to about four times the pitch P between the panel portion 11 and the ladder portion 12.

Note that in the case of the present example, the pitch P is set to about 6 to about 7 mm, and the pitch P6 to about 18 to about 20 mm.

The fabric 1 includes a plurality of yarns 13. That is, as shown in FIG. 3, the fabric 1 includes yarns 13 that form the panel portion 11. As shown in FIG. 6A, FIG. 6B and FIG. 7, the yarns 13 and the string portions 10 are each formed from a plurality of fiber filaments F1, F0. The yarns 13 forming a warp knit fabric may be a twisted yarn obtained by twisting together a large number of fiber filaments.

Some or all of the plurality of yarns 13 may be melt-binding yarns. The melt-binding yarns form a melt-binding structure where yarns are melt-bound together. The melt-binding yarns having the melt-binding structure melt-bind together yarns of the panel portion 11.

The melt-binding yarn forming the yarn 13 may be a twisted yarn, wherein a plurality of fiber filaments arranged on the outer circumference thereof are melt-binding fiber filaments. Alternatively, the melt-binding yarn forming the yarn 13 may be a twisted yarn, wherein the fiber filaments thereof are all melt-binding fiber filaments.

The yarns 13 and the string portions 10 are formed from non-stretching fiber filaments. The non-stretching fiber may be a polyester fiber, a nylon fiber, a rayon fiber, an acrylic fiber, or the like.

Figure 10A:
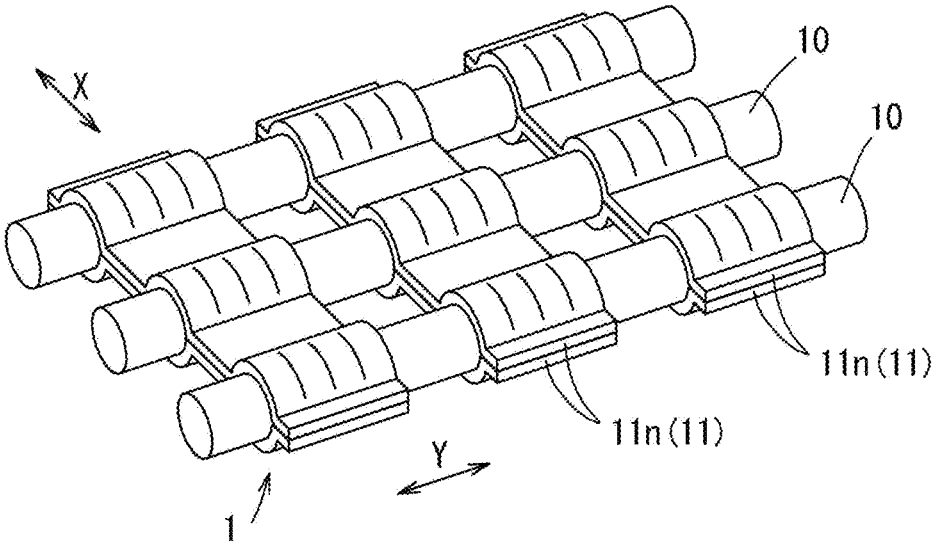
FIG. 10A is a conceptual perspective view showing, on an enlarged scale, a part of another example of a fabric.
Figure 10B:
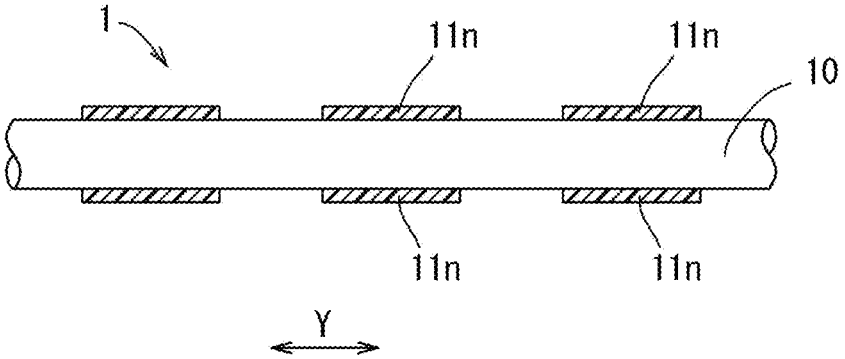
FIG. 10B is a cross-sectional view thereof.

FIG. 10A and FIG. 10B show another example of the string portion 10 and the panel portion 11.

In the present example, the panel portion 11 is formed from a pair of non-woven fabrics 11*n*. On the other hand, the string portion 10 is formed from a monofilament. The pair of non-woven fabrics 11*n* may be welded together and welded to the outer circumference of the string portion 10.

In the case of the present example, the string portion 10 will have a constant thickness. There may be no need for the panel portion 11 to fasten the string portion 10.

Figure 11A:
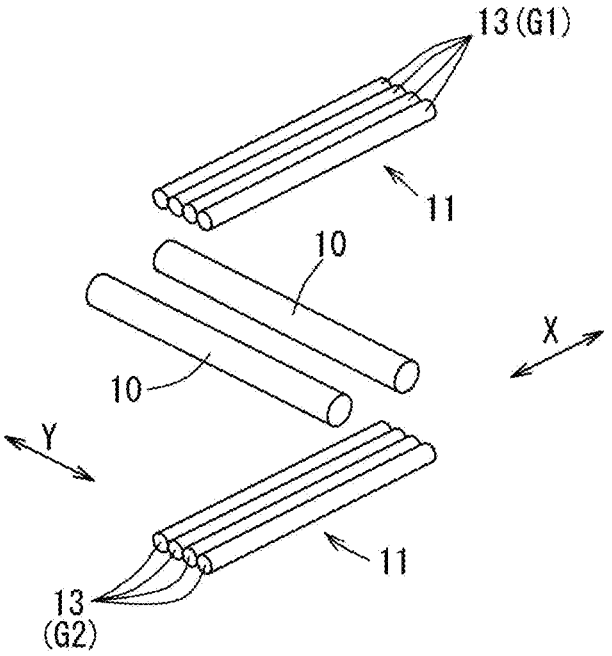
FIG. 11A, FIG. 11B and FIG. 11C are conceptual perspective views showing a part and a structure of another fabric.
Figure 11B:
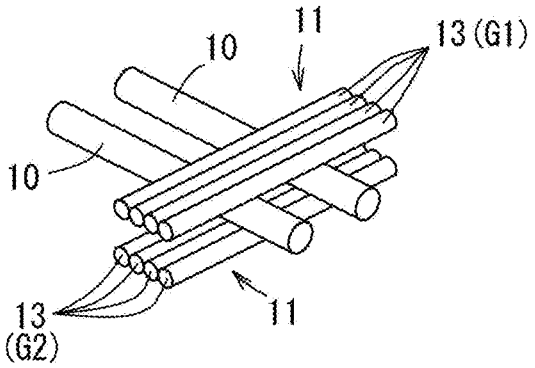
Figure 11C:
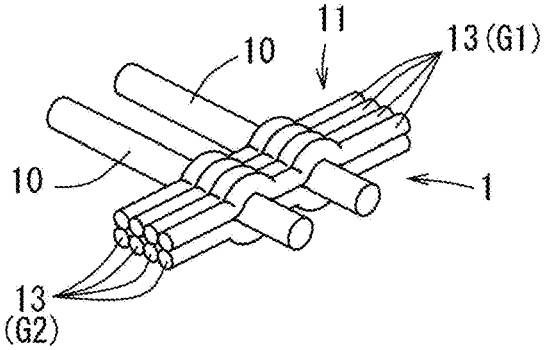

FIG. 11A to FIG. 11C show another example.

In the present example, the panel portion 11 is formed from a large number of yarns 13. The large number of yarns 13 form first and second groups G1, G2 that are arranged in parallel so as to be in contact with each other. The first and second groups G1, G2 sandwich the string portions 10 therebetween, thus forming the panel portion 11.

Figure 12:
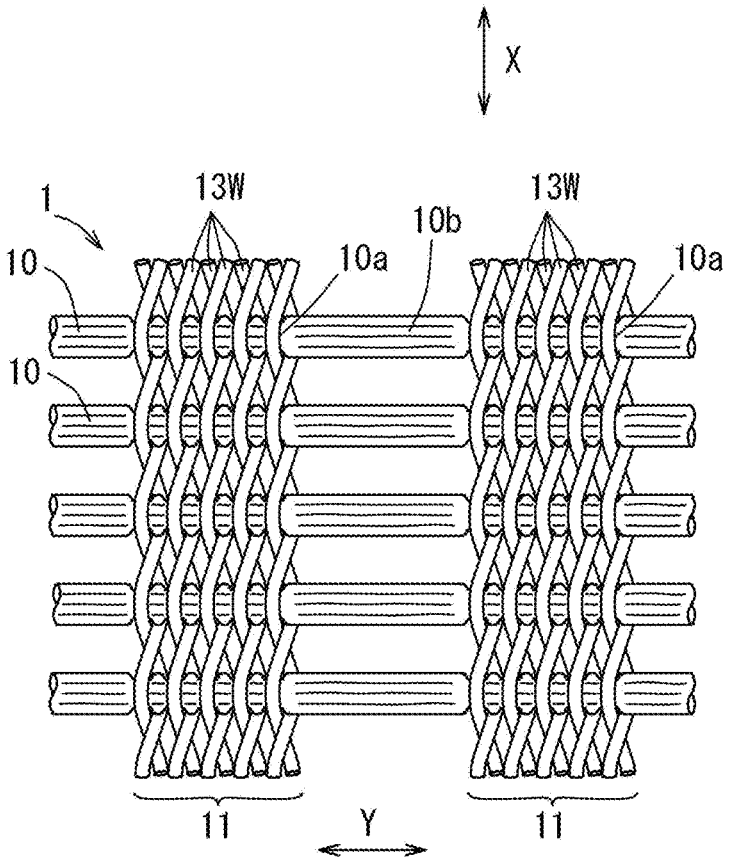
FIG. 12 is a conceptual plan view showing still another example of a fabric.

FIG. 12 shows still another example of the panel portion 11. The fabric 1 of the present example is formed from a woven fabric.

In the present example, the fabric 1 includes panel portions 11, which are formed from a large number of warp yarns 13W, and string portions 10, which are wefts. The string portions 10 may each be a non-twisted yarn including a large number of fiber filaments bundled together.

In the present example, the warp yarn 13W may be a melt-binding yarn. Each warp yarn 13W may be a twisted yarn including a large number of fiber filaments twisted together. Each warp yarn 13W may have the melt-binding structure where fiber filaments are melt-bound together. The warp yarns 13W may be melt-bound with each other. The warp yarns 13W may be melt-bound with each other, or the warp yarns 13W and the string portions 10 may be melt-bound with each other.

In FIG. 12, for the sake of illustration, the warp yarns 13W are drawn to be spaced apart from each other in the front-rear direction Y, in which the string portions 10 extend. However, the warp yarns 13W may be in contact with each other in the front-rear direction Y, and the warp yarns 13W, which are in contact with each other, may be melt-bound with each other.

Also with the woven fabric of the present example, the circumference of each string portion 10 is fastened by the warp yarns 13W of the panel portions 11, thereby making the thickness of the fastened portions 10*a* smaller than that of the exposed portions 10*b*.

While preferred embodiments have been described above with reference to the drawings, various obvious changes and modifications will readily occur to those skilled in the art upon reading the present specification.

For example, the sole arranged under the upper may only include a so-called outsole.

The panel portions and the string portions may be provided only in one of the toe portion, the medial portion and the lateral portion.

The tongue may be absent in the central portion of the upper.

The through holes for the shoelace may be loops, instead of being eyelets.

A belt may be employed as the fastening member instead of, or in addition to, a shoelace.

Thus, such changes and modifications are deemed to fall within the scope of the present invention, which is defined by the appended claims.

INDUSTRIAL APPLICABILITY

The present invention is applicable to shoes of various applications such as walking, as well as to running shoes.

REFERENCE SIGNS LIST

1: Fabric,
10: String portion,
10*a*: Fastened portion,
10*b*: Exposed portion
11: Panel portion,
11*n*: Non-woven fabric,
12: Ladder portion,
13: Yarn,
13*a*: Loop,
13W: Warp yarn
2: Reinforcement member,
3: Upper,
31: Medial portion,
32: Lateral portion,
33: Toe portion,
36: Central portion
5: Interior member
6: Fastening member,
60: Engagement portion
7: Top line,
8: Sole,
81: Insole
H: Through hole,
X: Girth direction,
y: Front-rear direction,
W: Minimum width of panel portion,
T1: Maximum thickness of string portion
P: Pitch between panel portion and string portion,
P6: Pitch between engagement portions

The invention claimed is:

1. An upper of a shoe configured to cover at least a part of a foot, the upper comprising:

a medial portion configured to cover a medial surface of the foot;

a lateral portion configured to cover a lateral surface of the foot;

panel portions provided in the medial portion and/or the lateral portion while being spaced apart from each other in a front-rear direction of the foot and extending in a foot girth direction crossing the front-rear direction of the foot; and string portions formed from linear members extending in the front-rear direction, and arranged so as to pass through the panel portions that are spaced apart from each other in the front-rear direction, wherein the panel portions and the string portions are formed from a single piece of fabric, wherein:

each of the panel portions is formed by a first group of yarns and a second group of yarns that are arranged in parallel so as to be in contact with each other, and the first group yarns and the second group of yarns sandwich the string portions therebetween;

each of the panel portions is in a strip shape extending in the girth direction and defines through holes that are spaced apart from each other in the girth direction;

one of the string portions is passed through one of the through holes;

in each of the through holes, the panel portions fasten a circumference of each of the string portions;

each of the string portions includes fastened portions that are fastened by the panel portions in the through holes of the panel portions, and exposed portions that are exposed between adjacent panel portions of the panel portions;

a thickness of the fastened portions in the foot girth direction is smaller than a thickness of the exposed portions in the foot girth direction;

each of the string portions is a bundle of fiber filaments, wherein the fiber filaments are not bonded together;

the fiber filaments are bundled more closely in the fastened portions than in the exposed portions;

the fastened portions and the exposed portions alternate with each other in the front-rear direction;

in the medial portion and/or the lateral portion, regions exposed between the panel portions define ladder portions on the upper, each of the ladder portions comprises a series of string portions and extends along the foot girth direction, the series of string portions are spaced apart from each other in the front-rear direction, each of the ladder portions is located between a pair of the panel portions that are adjacent to each other such that the ladder portions and the panel portions are arranged so as to alternate with each other in the front-rear direction, and the exposed portions of the string portions are exposed at the ladder portions;

the upper includes a fastening member configured to pull the panel portions toward a central portion between a medial side and a lateral side of the upper;

the medial portion and/or the lateral portion each include engagement portion with which the fastening member engages; and in the medial portion or the lateral portion, in the front-rear direction, two ladder portions with one panel portion located therebetween are arranged in each corresponding area defined by a width between two adjacent engagement portions such that a pitch between any two adjacent ladder portions is smaller than a pitch between any two adjacent engagement portions.

2. The upper according to claim 1, wherein an average value of a width of the panel portions in the front-rear direction is greater than an average value of a thickness of the string portions in the girth direction.

3. The upper according to claim 1, wherein adjacent string portions of the string portions extending in the front-rear direction are spaced apart from each other in the girth direction.

4. The upper according to claim 1, wherein each of the string portions is a non-twisted yarn.

5. The upper according to claim 1, wherein:

the piece of fabric includes yarns; and some or all of the yarns are melt-binding yarns, and the melt-binding yarns form a melt-binding structure where the yarns are melt-bound together.

6. The upper according to claim 5, wherein the melt-binding yarns having the melt-binding structure melt-bind together yarns of the panel portions.

7. The upper according to claim 5, wherein some or all of the yarns are non-stretching.

8. The upper according to claim 1, wherein each of the string portions is not twisted.

9. The upper according to claim 1, wherein the number of twists per inch in each of the string portions is 0 to 1.

10. The upper according to claim 1, wherein the number of twists per inch in each of the string portions is 0 to 0.5.

* * * * *